United States Patent [19]

Scribner

[11] 4,335,951

[45] Jun. 22, 1982

[54] FUSING APPARATUS

[75] Inventor: Albert W. Scribner, Darien, Conn.

[73] Assignee: Pitney Bowes Inc., Stamford, Conn.

[21] Appl. No.: 161,964

[22] Filed: Jun. 23, 1980

[51] Int. Cl.[3] ..... G03G 15/20

[52] U.S. Cl. ..... 355/3 FU; 219/216; 219/469; 355/3 SH; 432/60

[58] Field of Search ..... 355/3 R, 3 FU, 3 SH, 355/14 FU; 219/216, 469, 470, 471; 432/60, 228

[56] References Cited

U.S. PATENT DOCUMENTS

| | | | |
|---|---|---|---|
| 3,232,226 | 2/1966 | Schaum et al. | 219/470 X |
| 3,739,143 | 6/1973 | Amundson et al. | 219/216 |
| 4,001,544 | 1/1977 | Heinzer et al. | 219/216 |

FOREIGN PATENT DOCUMENTS

| | | | |
|---|---|---|---|
| 2425064 | 12/1975 | Fed. Rep. of Germany | 355/3 FU |

*Primary Examiner*—Fred L. Braun

*Attorney, Agent, or Firm*—Melvin J. Scolnick; William D. Soltow, Jr.; Albert W. Scribner

[57] ABSTRACT

A pressure fusing apparatus for use in a xerographic copying machine for fixing a developed toner image to a copy sheet. The apparatus includes in combination a first roller adapted to be rotatably mounted and driven within the copying machine; an arcuately shaped support member, the inner surface of which is spaced from and lies substantially parallel to a portion of the outer surface of the first roller; and a plurality of second smaller rollers mounted for rolling contact about the arcuately shaped support member, the second rollers and the first roller adapted to form a series of nips through which copy sheets being fused pass.

6 Claims, 3 Drawing Figures

FUSING APPARATUS

BACKGROUND OF THE DISCLOSURE

I. Field of the Invention

This invention related to a fusing apparatus as is commonly used in xerographic copying machines, and more particularly to a fusing apparatus for fusing toner images on a support surface such as a sheet of paper, by applying a plurality of pressure fusing roller strokes to a toned copy sheet in a highly mechanically efficient manner.

II. Description of the Prior Art

In a typical xerographic process a photoconductor comprising a photoconductive composition coated on a rigid or flexible substrate is uniformly electrostatically charged in the dark and then exposed by being illuminated in an image pattern in accordance with graphic material on an original document. The photoconductor becomes discharged in the areas exposed to the illumination, but retains its electrostatic charge in the dark areas, which areas correspond to the graphic material on the original document. The resulting electrostatic latent image is developed by depositing on the photoconductor a finely divided electrostatically attractable developing material (toner). The toner will normally be attracted to those areas on the photoconductor which retain a charge, thereby forming a toner image corresponding to the electrostatic latent image. This visible image of developing material is then transferred to a support surface, such as plain paper or any other suitable substrate, to become the ultimate copy. Any residual developing material remaining on the photoconductor is removed and the photoconductor is refused as described above for subsequent copies. The toner image that was transferred to the plain paper is then fixed thereto. The fusing process can be either a heat or cold process that employs pressure to fuse the toner particles to the substrate.

One very basic approach to fusing in a xerographic copying machine is the use of the so-called heat and pressure fusing apparatus. Typically, in this apparatus, the paper with the toner image thereon is passed between a pair of opposed and cooperating rollers, at least one of which is heated. Generally, the heated roll is formed of a hollow cylinder having a radiant heater, such as an infrared lamp or a halogen lamp, centrally located within the cylinder to heat the roll, in series with a bimetal thermostat. A typical example of this type of heated fuser roll is illustrated in U.S. Pat. No. 3,637,976. During operation of the fusing apparatus, the paper to which the toner images are electrostatically adhered, is passed through the nip formed between the rolls with the toner image contacting the fuse roll to effect heating of the toner image within the nip. Fusing is enhanced by the second roll or pressure roll as it is commonly called as the result of a biasing force which forces the rolls into engagement. A second basic approach to fusing is a cold pressure fusing process wherein once again paper with the toner image thereon (formed of cold pressure fusible toner particles) is passed through the nip formed between a pair of opposed and cooperating hard surfaced rollers. However, in a cold pressure fusing apparatus, fusing is accomplished by the use of pressure alone.

In general, it would be desirable to increase the operating efficiency of the above described fusing systems. With particular regard to cold pressure fusing systems, not only would it be desirable to increase their operating efficiency, but it would also be advantageous to be able to make these systems simple in design and as inexpensive as possible. Since cold pressure fusing systems fuse by pressure alone, large amounts of pressure must be applied to the rollers which therefor must of necessity be constructed of sufficient strength and size to withstand these large pressures. This of course, tends to make these systems mechanically complex and inefficient, and also expensive, all of which disadvantages are sought to be avoided by the present invention. Examples of some prior art systems which have sought to overcome these difficulties are described in U.S. Pat. Nos. 3,931,793 and 3,988,061.

SUMMARY OF THE INVENTION

It is therefore an object of the present invention to provide a fusing apparatus which operates in a highly mechanically efficient manner in applying pressure to a support surface.

It is a further object of the present invention to provide a pressure fusing apparatus that is simple in design and does not require the use of large and heavy rollers.

The foregoing objects and others are accomplished in accordance with the present invention by providing a pressure fusing apparatus for use in a xerographic copying machine for fixing a developed toner image to a copy sheet which includes in combination: a first roller adapted to be rotatably mounted and driven within the copying machine; an arcuately shaped support member, the inner surface of which is spaced from and lies substantially parallel to a portion of the outer surface of the first roller; and a plurality of second smaller rollers mounted for rolling contact about the arcuately shaped support member, the second rollers and the first roller adapted to form a series of nips through which copy sheets being fused pass.

DESCRIPTION OF THE PREFERRED EMBODIMENT

Figure 1:
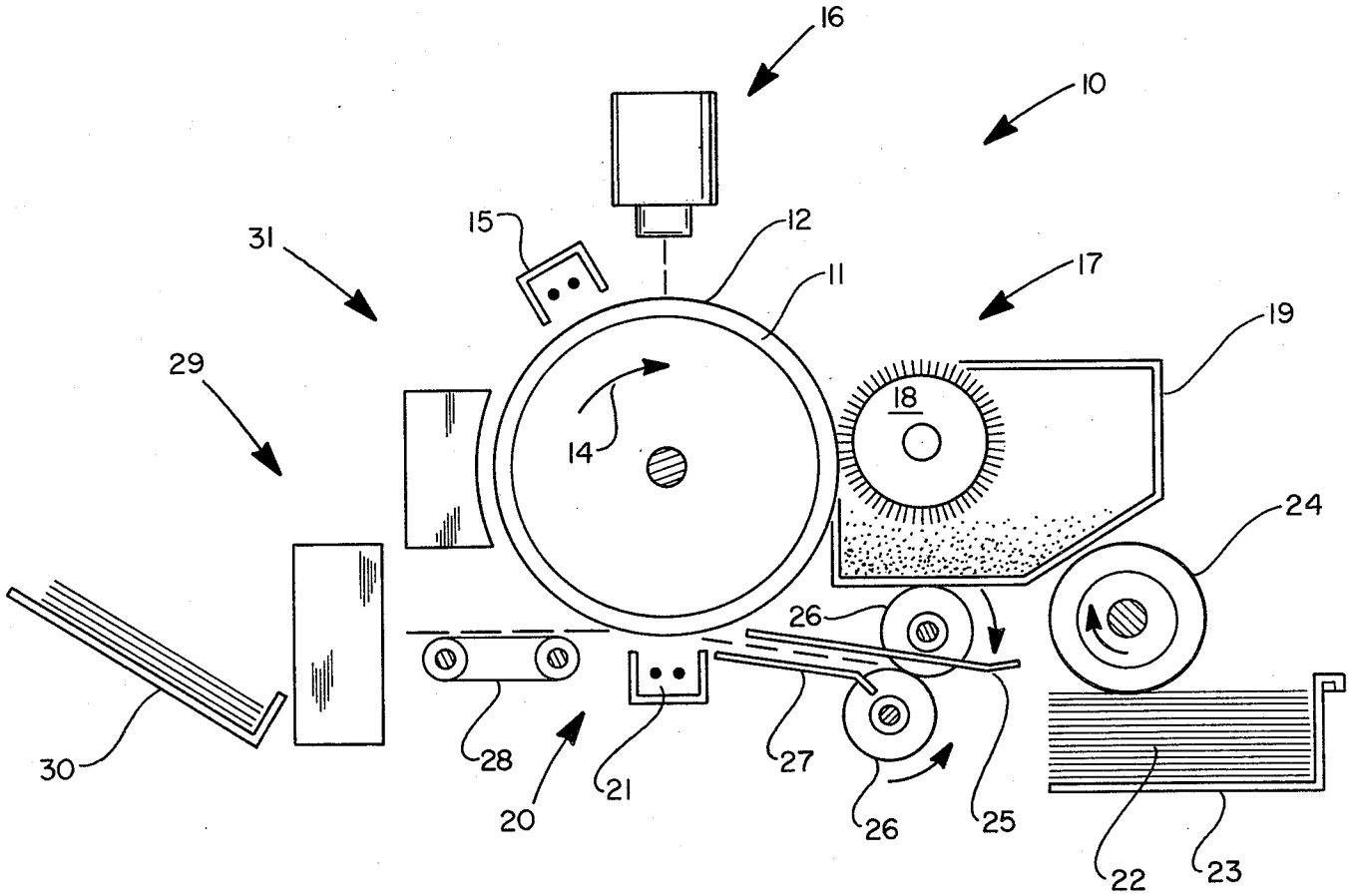
FIG. 1 is a schematic sectional view of a copier.

Referring now to the drawings, and particularly to FIG. 1 thereof, there is shown an electrophotographic copying machine employing a fusing device in which the fusing apparatus in accordance with the present invention can be utilized. The various processing stations shown in FIG. 1 will be represented in part as blocks and the processing stations will only be briefly described. The particular copying machine illustrated in FIG. 1 is merely exemplary as far as the present invention is concerned for a complete understanding of a xerographic process and, in particular, how a fusing apparatus is employed in such a process. An improved fusing apparatus in accordance with the present invention may be utilized in a wide variety of devices including coated paper copiers, plain paper copiers, copiers using hot or cold pressure fusing systems, and is not necessarily limited to the particular type of copier system shown in FIG. 1.

In FIG. 1, reference numeral 10 generally designates an electrophotographic copying machine which includes a rotating drum 11 having photoconductive surface 12 secured around the outer surface of the drum. Any of the numerous inorganic or organic photoconductive materials can be employed, such as for example, a selenium alloy. Additionally, the photoconductor can be in the form of a belt instead of a drum. As a drum 11 rotates in the direction of arrow 14, it passes through the various processing stations disposed around the periphery of the drum.

First, drum 11 rotates a portion of photoconductive surface 12 through a charging apparatus which includes a corona generating device 15 that is positioned closely adjacent the surface of the photoconductor. Corona generating device 15 imparts a uniform electrostatic charge to photoconductor surface 12.

An image of the document to be copied is transmitted to photoconductor surface 12 by the exposure and imaging station generally designated 16. This station could, for example, include a reciprocating carriage that is movably mounted on top of the copying machine cabinet. The carriage would include a transparent platen on which documents are placed faced down for copying. Overlying the platen would be a movable cover connected to one side of the carriage. An operator can raise and lower the cover and thereby place on or remove documents from the platen. A series of lamps would be used to illuminate the original document. By incorporating an optical system comprising a series of mirrors and lenses a light image of the original document to be copied is projected onto the charged portion of photoconductive surface 12. The movement of the carriage and therefore the scanning of the original document is in timed relationship with the movement of rotating drum 11. Thus, photoconductive surface 12 is selectively exposed to dissipate the charge thereon and record an electrostatic latent image corresponding to the indicia on the original document.

As drum 11 rotates, the latent image on photoconductive surface 12 is carried past a developer station 17. The developer material used can, for example, be a two component developer which comprises carrier particles having toner particles adhering thereto. The carrier particles are formed of a magnetic material while the toner particles are usually a heat settable plastic. However, a single component toner can also be used. Preferably a magnetic brush developing unit is used in which a rotating magnetic roll 18 picks up toner from a hopper 19 to form a rotating magnetic brush, and carries that toner onto contact with the latent image on photoconductive surface 12. The charged or latent image area of the photoreceptor electrostatically attracts and holds the toner particles, thus developing the latent image.

Transfer station 20 includes a corona transfer charging apparatus 21. In timed relationship with the arrival of the developed image at transfer corona 21, a copy sheet also arrives at transfer station 20. The copy sheet is fed from a supply of sheets 22 stored in removable tray 23. A feed roller 24 feeds the uppermost copy sheet from the supply 22, through paper guide 25 and into the nip of quering rollers 26. At a predetermined time in the course of a copy cycle, the quering rollers 26 are actuated to feed the copy sheet along paper guide 27 and into contact with the developed image carried on photoreceptor surface 12. By virtue of the electric charge that is generated by transfer corona 21, toner particles are attracted from photoreceptor surface 12 toward the copy sheet to which they loosely adhere. After transferring the toner powder to the copy sheet, the sheet is stripped away from drum 11 by a suitable apparatus, and advanced by belt conveyor 28 to fixing station 29.

Figure 3:
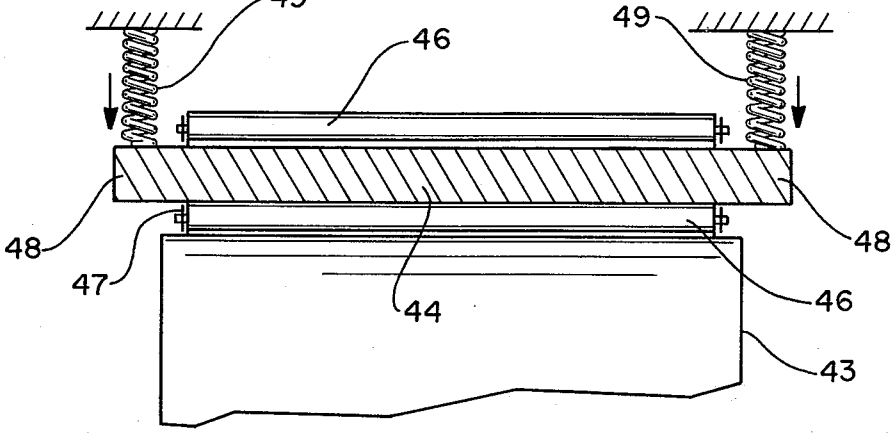
FIG. 3 is a schematic cross sectional view of the embodiment shown in FIG. 2 taken along line A—A.
Figure 2:
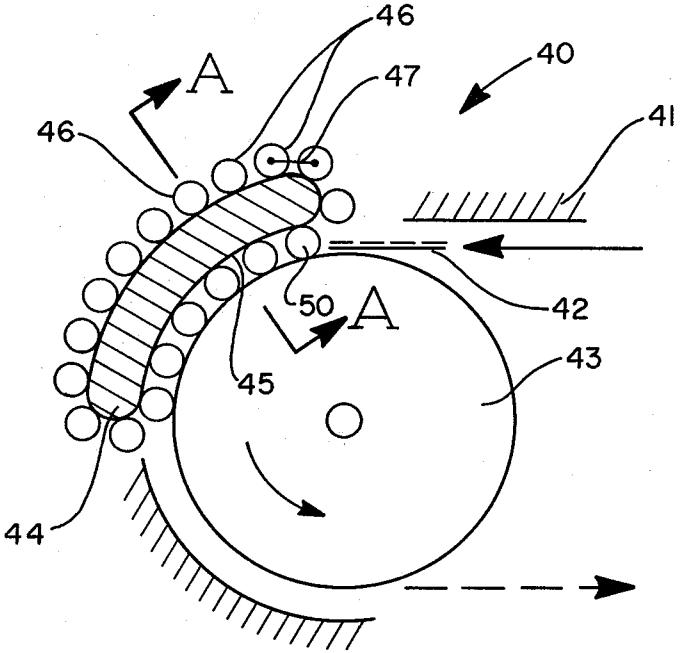
FIG. 2 is a schematic sectional view of an embodiment of a fusing apparatus in accordance with the present invention.

The copy sheet then passes into fixing station 29 that includes a fusing apparatus that can fuse by heating the toner to a temperature at which the toner particles melt and then applying pressure to the melted particles so as to form a permanent copy of the original document. Alternatively other types of toner materials and/or fusing systems can be used; for example, toners that can be fused by a cold pressure process wherein fusing is accomplished by the use of pressure alone can be used. In accordance with the present invention a fusing apparatus employing the fusing system as shown in FIGS. 2 and 3, and as more fully described hereinbelow can be used. After the toner image is permanently affixed to the copy sheet, the sheet is advanced to a catch tray 30 for subsequent removal from the copier by an operator.

In order to remove residual toner particles which adhere to photoconductive surface 12 after the transfer of the powder image to the copy sheet, copying machine 10 is provided with a cleaning system generally designated as 31. The cleaning system can, for example, include a corona generating device and a brush which contacts photoconductive surface 12. First, the remaining toner particles are brought under the influence of the corona generating device to neutralize the electrostatic charge remaining on photoconductive surface 12 and that of the residual toner particles. Thereafter, the neutralized particles are removed from surface 12 by the rotatably mounted brush. After the cleaning operation, a discharge lamp can be used to discharge remaining charges on surface 12 prior to the recharging thereof at corona device 15 for the next copying cycle.

Referring now to the specific subject matter of the present invention, there is illustrated in FIGS. 2 and 3 a preferred embodiment of a pressure type fusing apparatus in accordance with the features of the present invention. Specifically, there is shown a fusing apparatus 40 for use in a xerographic type copying machine for fixing a developed toner image to a copy sheet. Conventional type guide means 41 are adapted to usher a copy sheet 42 having a developed toner image thereon through the fusing apparatus. The apparatus includes a main or first roller 43 that is adapted to be rotatably mounted and driven on the copying machine frame by a drive system (not shown) in the direction as shown. Cooperating with the outer periphery of roller 43 is an arcuately shaped support member 44 the inner surface of which 45 is spaced from and lies substantially parallel to a portion of the outer surface of first roller 43. Mounted for rolling contact about the outer periphery of arcuately shaped support member 44 are a plurality of rollers 46 that are smaller in diameter than roller 43. Rollers 46 are preferably all substantially equal in size and are interconnected at their respective outer ends by a series of uniform chain links 47. When in an operative position as shown in FIG. 1, the inner concave surface 45 of member 44 is disposed concentric with respect to a portion of the outer periphery of roller 43, and the outer surfaces of rollers 46 and part of the periphery of roller 43 form a series of nips through which a copy sheet 42 being fused passes.

The outer ends 48 of arcuate member 44 are preferably biased toward roller 43 by any suitable means, such as adjustable spring means 49, as shown in FIG. 2, so that rollers 46 on the concave portion of member 44 are pressed against the adjacent peripheral portion of roller 43 to the degree necessary for proper pressure fusing conditions. With this type of mechanical arrangement rotation of roller 43 by a drive system will frictionally cause rollers 46 to move and thereby circulate around arcuate member 44 so that during contact with the concave surface of member 44, rollers 46 planetate about the axis of roller 43 in a manner operationally similar to that in a roller bearing. Of course, it is also within the scope of the present invention that interconnected rollers 46 be driven by a separate drive system in timed relation with respect to the driving action being used for roller 43. When roller 43 is rotatably driven as indicated by the arrow, the toned copy sheet 42 will be successively pressure rolled during the over-lapping rolling strokes of the frictionally driven planetating rollers 46 as the copy sheet moves around the axis of roller 43 and through the fuser system.

It is within the scope of the present invention that the fusing system described herein can fuse by using either a cold or hot fusing process. Thus, for example, the external surfaces of one or more of rollers 46 can be heated by the use of one or more radiant heaters properly positioned with respect to these rollers. Copy sheet 42 with unfused toner particles thereon can arrive at the entrance of the fusing apparatus at guide means 41. Immediately thereafter, the toner particles may be subjected to both heat and pressure as the copy sheet enters the nip between rolls 50 and 43. As the toner melts it can at the same time be pressed into the copy sheet by the roller pressure exerted by rollers 46 and 43. If the fusing system employs a cold fusing process, then due to the composition of the toner employed and the use of pressure alone, the toner can be fused to the copy sheet.

In accordance with the present invention, the particular sizes that are selected for the smaller rollers 46 and the larger roller 43 can vary, and such selections should be able to be made by one having ordinary skill in the art. An example of possible sizes for the pressure rolls would be a two inch outer diameter for the larger roller 43 and 3/16 inch outer diameter for the smaller rollers 46. The structure for the rolls used in the fusing assembly in accordance with the present invention, and the particular materials used for these rolls can vary and be selected from any of the well known structures and materials used in heat or cold pressure fusing systems that are known in the art. For example, the larger roller 43 can be either of a solid or tubular steel construction, and smaller rollers 46 can be of solid steel construction. Since it is possible for toner particles to be offset to the outer fusing surfaces of the fusing rolls, certain coatings can be used to prevent this problem. One possible way to minimize this problem, commonly referred to in the art as "offsetting", would be to provide the outer surfaces of rollers 43 and 46 with an outer surface layer or covering of polytetraflouroethylene, sold under the trademark "Teflon" by the E. I. DuPont de Nemours and Co., to which a release agent such as, for example, silicone oil is applied. Of course, any of the procedures known in the art for preventing offsetting can be used.

While this invention has been described in conjunction with specific embodiments thereof, it is evident that many alternatives, modifications and variations will be apparent to those skilled in the art. Accordingly, the present invention is intended to embrace all such alternatives, modifications and variations and fall within the spirit of the appended claims.

I claim:

1. A pressure fusing apparatus for use in a xerographic copying machine for fixing a developed toner image to a copy sheet comprising in combination a first roller adapted to be rotatably mounted and driven within said machine; an arcuately shaped support member, the inner surface of which is spaced from and lies substantially parallel to a portion of the outer surface of said first roller; spring means for biasing said arcuately shaped support member toward said first roller; and a plurality of interconnected second rollers having a smaller outside diameter than said first roller mounted for rolling contact about said arcuately shaped support member, said second rollers and said first roller adapted to form a series of nips through which copy sheets being fused pass.

2. A pressure fusing apparatus according to claim 1 wherein the outside diameter of each of said second rollers is about 3/16 inch and the outside diameter of said first roller is about 2 inches.

3. A pressure fusing apparatus according to claim 1 wherein said spring means in positioned at each of the outer end portions of said support member.

4. A pressure fusing apparatus according to claim 1 wherein said second rollers are driven around said arcuate member by frictional contact with said driven first roller.

5. A pressure fusing apparatus according to claim 1 wherein said apparatus is a heat pressure fusing apparatus and further comprises heating means for heating said second rollers whereby a combination of heat and pressure is applied to said copy sheet as it passes through said nip and into the area of contact between said first and second rollers.

6. A pressure fusing apparatus according to claim 1 wherein said apparatus is a cold pressure fusing apparatus.

* * * * *